US006202749B1

(12) United States Patent
Adams et al.

(10) Patent No.: US 6,202,749 B1
(45) Date of Patent: Mar. 20, 2001

(54) WELL SCREEN SYSTEM

(76) Inventors: David L. Adams; Mary E. Adams, both of P.O. Box 41, Powhatan, VA (US) 23139

( * ) Notice: Subject to any disclaimer, the term of this patent is extended or adjusted under 35 U.S.C. 154(b) by 0 days.

(21) Appl. No.: 09/244,406

(22) Filed: Feb. 4, 1999

(51) Int. Cl.[7] ..... E03B 3/18; E21B 43/00; E02B 6/08

(52) U.S. Cl. ..... 166/227; 210/162; 210/166; 210/170; 210/249

(58) Field of Search ..... 166/227, 230, 166/235; 248/317, 343; 210/162, 163, 166, 170, 249, 250

(56) References Cited

U.S. PATENT DOCUMENTS

| | | | | |
|---|---|---|---|---|
| 122,209 | * | 12/1871 | Ashman et al. | 210/162 |
| 674,294 | * | 5/1901 | Cox | 4/289 |
| 1,514,979 | * | 11/1924 | McMillin | 210/162 |
| 2,524,242 | * | 10/1950 | Weaver | 248/343 |
| 3,920,347 | * | 11/1975 | Sauriol et al. | 404/25 |
| 4,122,762 | * | 10/1978 | Williams | 248/343 |
| 4,443,897 | * | 4/1984 | Austin | 4/291 |
| 4,793,387 | * | 12/1988 | LeBlanc et al. | 141/86 |
| 4,974,992 | * | 12/1990 | Harter | 404/25 |
| 5,232,587 | * | 8/1993 | Hegemier et al. | 210/162 |
| 5,284,580 | * | 2/1994 | Shyh | 210/163 |
| 5,397,464 | * | 3/1995 | Hannon | 210/163 |
| 5,404,676 | * | 4/1995 | Devlin | 49/463 |
| 5,529,431 | * | 6/1996 | Walsh | 404/25 |
| 5,776,033 | * | 7/1998 | Brown | 482/40 |
| 5,849,198 | * | 12/1998 | Sharpless | 210/693 |

* cited by examiner

*Primary Examiner*—Eileen D. Lillis
*Assistant Examiner*—Gary S. Hartmann

(57) ABSTRACT

A well screen for preventing contaminants such as debris, pests, and insects from falling into the well water. The well screen includes a barrier having top and bottom faces with a plurality of apertures therethrough. A plurality of elongate hanging arms are upwardly extended from the top face of the barrier. The hanging arms each have an outwardly extending upper extent.

5 Claims, 2 Drawing Sheets

WELL SCREEN SYSTEM

BACKGROUND OF THE INVENTION

1. Field of the Invention

The present invention relates to well screens and more particularly pertains to a new well screen for preventing contaminants such as debris, pests, and insects from falling into the well water.

2. Description of the Prior Art

The use of well screens is known in the prior art. More specifically, well screens heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,167,743 by Caluwe; U.S. Pat. No. 5,427,417 by Lechuga; U.S. Pat. No. 4,443,897 by Austin; U.S. Pat. No. 2,837,032 by Horsting, Sr.; U.S. Pat. No. 5,297,299 by Wilson; and U.S. Pat. No. Des. 390,910 by Sundquist.

While these devices fulfill their respective, particular objectives and requirements, the aforementioned patents do not disclose a new well screen. The inventive device includes a barrier having top and bottom faces with a plurality of apertures therethrough. A plurality of elongate hanging arms are upwardly extended from the top face of the barrier. The hanging arms each have an outwardly extending upper extent.

In these respects, the well screen according to the present invention substantially departs from the conventional concepts and designs of the prior art, and in so doing provides an apparatus primarily developed for the purpose of preventing contaminants such as debris, pests, and insects from falling into the well water.

SUMMARY OF THE INVENTION

In view of the foregoing disadvantages inherent in the known types of well screens now present in the prior art, the present invention provides a new well screen construction wherein the same can be utilized for preventing contaminants such as debris, pests, and insects from falling into the well water.

The general purpose of the present invention, which will be described subsequently in greater detail, is to provide a new well screen apparatus and method which has many of the advantages of the well screens mentioned heretofore and many novel features that result in a new well screen which is not anticipated, rendered obvious, suggested, or even implied by any of the prior art well screens, either alone or in any combination thereof.

To attain this, the present invention generally comprises a barrier having top and bottom faces with a plurality of apertures therethrough. A plurality of elongate hanging arms are upwardly extended from the top face of the barrier. The hanging arms each have an outwardly extending upper extent.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new well screen apparatus and method which has many of the advantages of the well screens mentioned heretofore and many novel features that result in a new well screen which is not anticipated, rendered obvious, suggested, or even implied by any of the prior art well screens, either alone or in any combination thereof.

It is another object of the present invention to provide a new well screen which may be easily and efficiently manufactured and marketed.

It is a further object of the present invention to provide a new well screen which is of a durable and reliable construction.

An even further object of the present invention is to provide a new well screen which is susceptible of a low cost of manufacture with regard to both materials and labor, and which accordingly is then susceptible of low prices of sale to the consuming public, thereby making such well screen economically available to the buying public.

Still yet another object of the present invention is to provide a new well screen which provides in the apparatuses and methods of the prior art some of the advantages thereof, while simultaneously overcoming some of the disadvantages normally associated therewith.

Still another object of the present invention is to provide a new well screen for preventing contaminants such as debris, pests, and insects from falling into the well water.

Yet another object of the present invention is to provide a new well screen which includes a barrier having top and bottom faces with a plurality of apertures therethrough. A plurality of elongate hanging arms are upwardly extended from the top face of the barrier. The hanging arms each have an outwardly extending upper extent.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
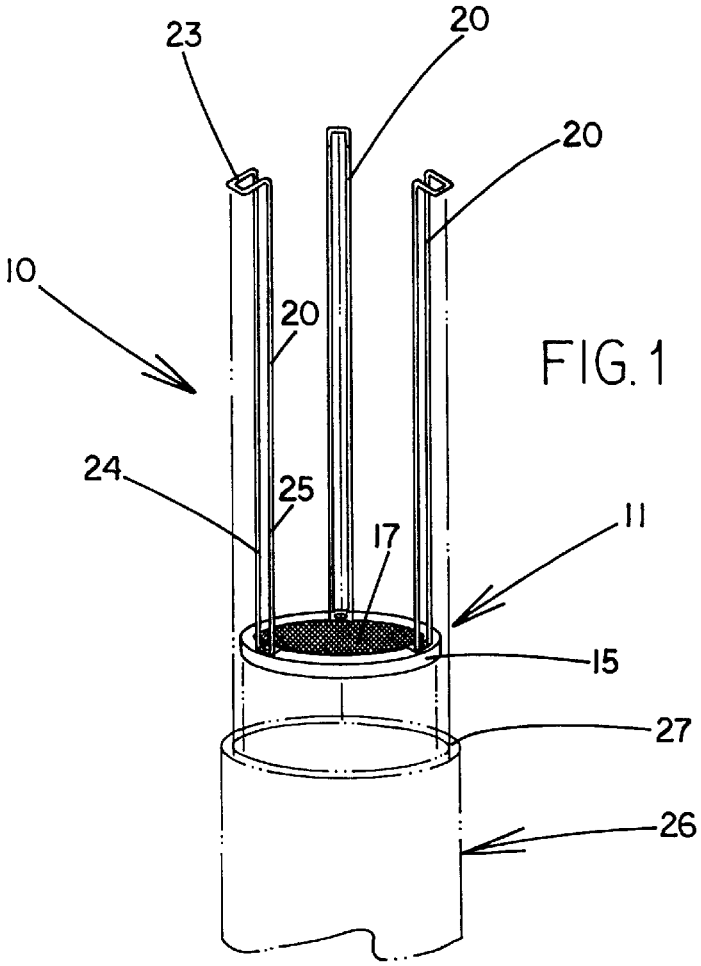
FIG. 1 is a schematic perspective view of a new well screen removed from a well hole according to the present invention.
Figure 2:
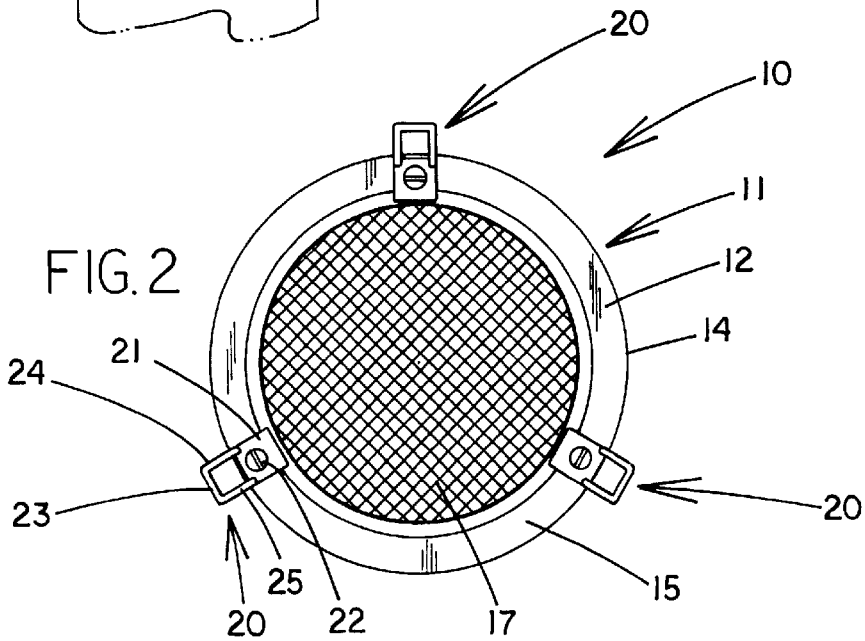
FIG. 2 is a schematic top view of the present invention.

With reference now to the drawings, and in particular to FIGS. 1 through 4 thereof, a new well screen embodying the principles and concepts of the present invention and generally designated by the reference numeral 10 will be described.

As best illustrated in FIGS. 1 through 4, the well screen 10 generally comprises a barrier having top and bottom faces with a plurality of apertures therethrough. A plurality of elongate hanging arms are upwardly extended from the top face of the barrier. The hanging arms each have an outwardly extending upper extent.

In closer detail, the well screen 10 comprises a generally disk-shaped barrier 11 having top and bottom faces 12,13, a generally circular outer perimeter 14, and a center. The outer perimeter of the barrier defining an outer diameter of the barrier. In an ideal embodiment, the barrier has a thickness defined between the top and bottom faces of the barrier of about 1 inch.

Preferably, the barrier comprises an open outer ring 15 extending along the outer perimeter of the barrier. The outer ring has an inner perimeter 16 defining a generally circular center opening through the outer ring. The barrier further comprises a generally circular flat mesh screen 17 has a plurality of apertures of a predetermined size therethrough to prevent passage of objects greater than the predetermined size (such as debris, pests, and insects) through the screen of the barrier. Ideally, the screen and the outer ring comprise a fiberglass material or a stainless steel material to prevent damage to the barrier from exposure to water such as is submerged in the well water.

Figure 3:
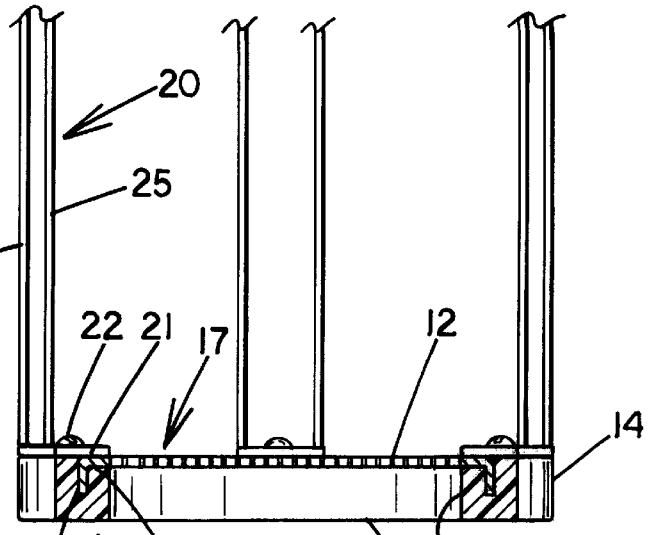
FIG. 3 is a schematic cross sectional view of the barrier of the present invention.

The screen of the barrier substantially covers the center opening of the outer ring at the top face of the barrier. Preferably, as illustrated in FIG. 3, the outer ring of the barrier has an annular inner shoulder 18 around the inner perimeter of the outer ring of the barrier adjacent the top face of the barrier. The inner shoulder of the outer ring lies in a plane spaced apart from and substantially parallel to the top face of the barrier. The screen is rested on the inner shoulder of the outer ring. Additionally, in this preferred embodiment, the outer ring of the barrier has annular groove therearound adjacent the inner shoulder of the outer ring. The screen of the barrier has an annular lip 19 downwardly extending therearound and inserted into the groove of the outer ring to couple the screen to the outer ring.

A plurality of elongate hanging arms 20 are upwardly extended from the top face of the barrier. Ideally, the plurality of hanging arms comprises three hanging arms for optimal stability of the well screen. Each of the hanging arms has opposite top and bottom ends, and a longitudinal axis extending between the top and bottom ends of the respective hanging arm. The bottom ends of the hanging arms each have an inwardly extending foot 21 coupled by removable fasteners 22 to the top face of the barrier at the outer ring of the barrier. The hanging arms are preferably spaced apart along the outer perimeter of the barrier at substantially equal intervals. In this preferred embodiment, the longitudinal axes of the hanging arms are extended substantially perpendicular to the top face of the barrier. The hanging arms each have a length defined between the top and bottom ends of the respective hanging arm. Preferably, the lengths of the hanging arms are substantially equal to one another. Ideally, the length of each hanging arm is between 8 inches and 36 inches.

The top ends of the hanging arms each have an outwardly extending upper extent 23. Ideally, each of the upper extents has a length defined outwardly from the top end of the associated hanging arm of at least about 1 inch and less than about 10 inches. Preferably, each of the upper extents is extended substantially perpendicular to the longitudinal axis of the associated hanging arm. In this preferred embodiment, the upper extents lie in a common plane substantially parallel to the top face of the barrier.

Ideally, each of the hanging arms comprises a spaced apart pair of substantially parallel elongate rods 24,25 integrally connected together at the associated upper extent for minimizing the weight of each hanging arm while maximizing the structural strength of each hanging arm.

Figure 4:
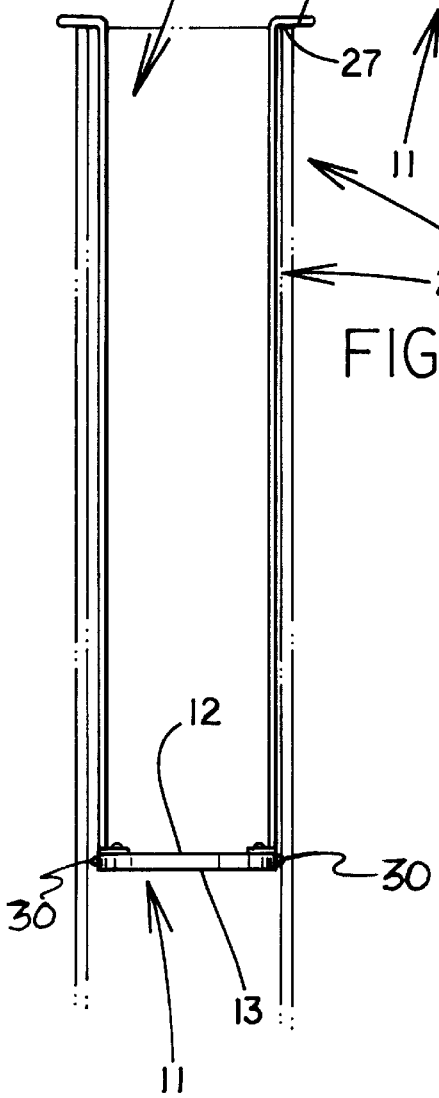
FIG. 4 is a schematic side view of the present invention in a well hole.

The well screen is designed for use in a generally cylindrical well hole 26 with an open top 27, a generally circular inner periphery or circumference, and a longitudinal axis. The inner periphery of the well hole defines an inner diameter of the well hole. With reference to FIGS. 1 and 4, in use, the barrier is inserted into the well hole such that the hanging arms upwardly extend towards the top of the well hole. The upper extents are rested on the top of the well hole to hanging the hanging arms from the top of the well hole. Preferably, the center of the barrier is substantially coaxial with the longitudinal axis of the well hole. Even more preferably, the top and bottom faces of the barrier lie in planes substantially perpendicular to the longitudinal axis of the well hole. The outer perimeter of the barrier preferably abuts the inner periphery of the well hole completely therearound to prevent contaminating objects, such as debris, pests, and insects from passing between the inner periphery of the well hole and the outer perimeter of the barrier. Ideally 30, a sealant, such as a caulking or silicone sealant, is interposed between the outer perimeter of the barrier and the inner periphery of the well hole to form a substantially water-tight seal between the outer perimeter of the barrier and the inner periphery of the well hole.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A well screen system comprising:

a generally cylindrical well hole having a generally circular inner periphery and an upper perimeter edge; and a well screen comprising:

a barrier having top and bottom faces, and an outer perimeter;

said barrier having a plurality of apertures therethrough;

a plurality of elongate hanging arms suspending said barrier from the upper perimeter edge of said well hole such that said barrier is positioned below said upper perimeter edge, said hanging arms being upwardly extended from said top face of said barrier;

said hanging arms each having an outwardly extending upper extent;

said outer perimeter of said barrier abutting against the inner periphery of said well hole in a continuous manner along the outer perimeter for forcing fluid flow through said plurality of apertures to prevent contaminating objects from passing between the inner periphery of said well hole and said outer perimeter of said barrier; and a blocking substance being mounted on the outer perimeter of said barrier interposed between said outer perimeter of said barrier and said inner periphery of said well hole to form a substantially water-tight obstruction between said outer perimeter of said barrier and said inner periphery of said well hole;

wherein said barrier comprises an open outer ring extending along said outer perimeter of said barrier, said outer ring having an inner perimeter defining a generally circular center opening through said outer ring, wherein said barrier further comprises a screen, said screen of said barrier substantially covering said center opening of said outer ring at said top face of said barrier;

wherein said outer ring of said barrier has an annular inner shoulder around said inner perimeter of said outer ring of said barrier adjacent said top face of said barrier, wherein said screen is rested on said inner shoulder of said outer ring;

wherein said outer ring of said barrier has annular groove therearound adjacent said inner shoulder of said outer ring, wherein said screen of said barrier has an annular lip downwardly extending therearound, and wherein said annular lip of said screen is inserted into said groove of said outer ring;

wherein each of said hanging arms has opposite top and bottom ends, and a longitudinal axis extending between said top and bottom ends of the respective hanging arm, wherein said bottom ends of said hanging arms each are coupled to said top face of said barrier;

wherein said hanging arms are spaced apart along said outer perimeter of said barrier at substantially equal intervals;

wherein said longitudinal axes of said hanging arms are extended substantially perpendicular to said top face of said barrier; and wherein said upper extent of each hanging arm is positioned at said top end of the respective hanging arm, said upper extent being rested on the upper perimeter edge of the well hole.

2. The well screen of claim 1, wherein each of said upper extents is extended substantially perpendicular to said longitudinal axis of the associated hanging arm.

3. The well screen of claim 1, wherein each of said hanging arms comprises a spaced apart pair of substantially parallel elongate rods, the upper extents of said pair of elongate rods being connected together.

4. The well screen of claim 1, wherein the blocking substance comprises a silicone sealant for allowing removal of the barrier from the well hole.

5. A well screen system, comprising:

a generally cylindrical well hole having a top, a generally circular inner periphery, and a longitudinal axis;

a well screen comprising:

a generally disk-shaped barrier having top and bottom faces, a generally circular outer perimeter, and a center;

said barrier comprising an open outer ring extending along said outer perimeter of said barrier, said outer ring having an inner perimeter defining a generally circular center opening through said outer ring;

said barrier comprising a generally circular screen having a plurality of apertures therethrough;

said screen of said barrier substantially covering said center opening of said outer ring at said top face of said barrier;

said outer ring of said barrier having an annular inner shoulder around said inner perimeter of said outer ring of said barrier adjacent said top face of said barrier;

said inner shoulder of said outer ring lying in a plane spaced apart from and substantially parallel to said top face of said barrier;

said screen being rested on said inner shoulder of said outer ring;

said outer ring of said barrier having annular groove therearound adjacent said inner shoulder of said outer ring;

said screen of said barrier having an annular lip downwardly extending therearound and inserted into said groove of said outer ring;

a plurality of elongate hanging arms being upwardly extended from said top face of said barrier;

each of said hanging arms having opposite top and bottom ends, and a longitudinal axis extending between said top and bottom ends of the respective hanging arm;

said bottom ends of said hanging arms each being coupled to said top face of said barrier at said outer ring of said barrier;

said hanging arms being spaced apart along said outer perimeter of said barrier at substantially equal intervals;

said longitudinal axes of said hanging arms being extended substantially perpendicular to said top face of said barrier;

said top ends of said hanging arms each having an outwardly extending upper extent;

each of said upper extents being extended substantially perpendicular to said longitudinal axis of the associated hanging arm;

said upper extents lying in a common plane substantially parallel to said top face of said barrier;

wherein each of said hanging arms comprises a spaced apart pair of substantially parallel elongate rods connected together at the associated upper extent;

said barrier being inserted into said well hole such that said hanging arms upwardly extend towards said top of said well hole;

said upper extents being rested on said top of said well hole to hanging said hanging arms from said top of said well hole;

said center of said barrier being substantially coaxial with said longitudinal axis of said well hole;

said top and bottom faces of said barrier lying in planes substantially perpendicular to said longitudinal axis of said well hole;

said outer perimeter of said barrier abutting said inner periphery of said well hole therearound; and a sealant being interposed between said outer perimeter of said barrier and said inner periphery of said well hole to form a substantially water-tight seal between said outer perimeter of said barrier and said inner periphery of said well hole.

* * * * *